US005175923A

United States Patent [19]

Kase

[11] Patent Number: 5,175,923

[45] Date of Patent: Jan. 5, 1993

[54] METHOD FOR PRODUCING A LAMINATED COIL

[75] Inventor: Hiroaki Kase, Machida, Japan

[73] Assignee: Murata Mfg. Co., Ltd., Kyoto, Japan

[21] Appl. No.: 667,744

[22] Filed: Mar. 11, 1991

[30] Foreign Application Priority Data

Mar. 31, 1990 [JP] Japan ..... 2-87200

[51] Int. Cl.[5] ..... H01F 41/04

[52] U.S. Cl. ..... 29/602.1; 336/200; 336/232

[58] Field of Search ..... 29/602.1, 606, 605; 336/200, 232

[56] References Cited

U.S. PATENT DOCUMENTS 2,666,254 1/1954 Eisler ..... 29/602.1
3,769,698 11/1973 Lademann et al. ..... 29/602.1
4,313,152 1/1982 Vranken ..... 336/200 X

*Primary Examiner*—Carl E. Hall
*Attorney, Agent, or Firm*—Oliff & Berridge

[57] ABSTRACT

A laminated coil comprises a plurality of super-imposed insulating films each having a conductive member and a through-hole. One end portion of the conductive member extends as a tongue. The tongue of each conductive member on each insulating film is electrically connected to the associated conductive member on the adjacent insulating film via the corresponding through-hole.

9 Claims, 3 Drawing Sheets

METHOD FOR PRODUCING A LAMINATED COIL

BACKGROUND OF THE INVENTION

1. Field of the Invention

This invention relates to a laminated coil which is applicable as a transformer or a coil in a switching power supply such as a DC-DC converter, and also relates to a method for producing such a laminated coil.

2. Description of the Related Art

Heretofore, a laminated coil has been widely produced by using insulating films through development in printed wiring techniques and thin film techniques. Such a laminated coil is usually produced as described below. Firstly, a number of spiral patterns are formed on insulating films. The insulating films are then superimposed one over another. The end portion of the spiral pattern of an insulating film is connected to the beginning portion of the spiral pattern on an upper insulating film by means of the through-hole technique.

In detail, there are provided a plurality of strip-shaped insulating films which have spiral patterns disposed at regular intervals. A first insulating film is let out such as by a sprocket wheel, and a second insulating film is fed over the first insulating film. The end of the spiral pattern of the first insulating film is connected, by the soldering for example, to the beginning of the spiral pattern of the second insulating film via a through-hole. Then, a third insulating film is superimposed on the second insulating film. The end of the spiral pattern of the second film is connected, by soldering for example, to the beginning of the spiral pattern of the third insulating film. Succeeding insulating films are superimposed as described above. The spiral patterns of the first to the n-th insulating films are interconnected so as to obtain laminated coils having a plurality of turns. The insulating films are then cut to separate the coil patterns from one another.

However, with the conventional laminated coil, it has taken time to connect, by soldering for example, the spiral patterns of a pair of adjacent insulating films via the through-hole. In addition, the production line has to be interrupted for the connection of the spiral patterns, thereby reducing the production efficiency of the laminated coils.

SUMMARY OF THE INVENTION

Therefore it is an object of this invention to provide a laminated coil and a method for producing the same efficiently without interrupting the production line for a long period of time.

According to this invention, there is provided a laminated coil comprising: a plurality of insulating films superimposed one over another, each of the insulating films having a plurality of through-holes at predetermined positions thereof; a plurality of conductive members disposed on each insulating film, some of conductive members on the insulating films being associated with one another to jointly constitute at least a part of a coil; and a plurality of tongues each extending from each conductive member, each tongue on each of the insulating films being adapted to be electrically connected to associated conductive member on the adjacent insulating film via the respective through-hole.

The conductive members on the insulating films can be easily connected in short period of time without interrupting the production line.

Each of the conductive members on the respective insulating film may extend in a spiral pattern. Generally a coil comprises a number of turns of wires. And in this invention, the conductive member having the spiral pattern effectively constitutes a part of the coil turns.

An adjacent pair of the associated conductive members disposed on the adjacent insulating films and adapted to be electrically connected to one another by the tongue of one of the adjacent associated conductive members extend in opposite spiral patterns.

A pair of the adjacent associated insulating films are connected by the tongue extending from the conductive member on one of the associated insulating films. The positions of the tongues are determined as follows. For example, one of the adjacent associated tongues extends from an inner end of the spiral pattern of the corresponding conductive member, and the other adjacent associated tongue extends from an outer end of the spiral pattern of the corresponding conductive member. When these insulating films are alternately superimposed, the conductive members and the tongues can be connected without any interference between the tongues.

Each tongue extends from one end of the respective conductive member.

Each through-hole may be located substantially directly under the tongue of the corresponding conductive member. The insulating films may have a plurality of core-receptive holes each for receiving a non-illustrated core so that the associated conductive members on different films can be aligned in the direction of thickness of the films.

The present inventor(s) further proposes a method for producing a laminated coil, comprising the steps of: providing a plurality of insulating films each having a predetermined number of through-holes; mounting a predetermined number of conductive members on each of the insulating films, each of the conductive members having a tongue; superimposing the insulating films one over another; and electrically connecting the tongue of each conductive member on each said insulating film with the associated conductive member of the adjacent insulating film via the corresponding through-hole to obtain a predetermined number of coil patterns each for a laminated coil.

The proposed method is very effective to produce a plurality of laminated coils at a time. The superimposed insulating films are cut to separate the coil patterns from one another if the predetermined number of conductive members mounted on each insulating film during the mounting step is more than one and if the predetermined number of coil patterns obtained during the connecting step is more than one.

The connecting step further includes bonding the tongue of each conductive member to the adjacent associated conductive member.

The foregoing method further includes the step of impregnating the coil patterns with an insulating material.

The mounting step further includes applying a metallic foil on each insulating film, and shaping the metallic foil into a predetermined pattern to form the conductive members and also to form the tongues each integrally with the respective conductive member.

Further the superimposing step includes winding said insulating films around a roll.

The step of forming a plurality of core-receptive holes in each insulating film is included.

In addition, the foregoing method includes the step of forming a predetermined number of through-holes in each insulating film.

DETAILED DESCRIPTION

An embodiment of this invention will be described with reference to the accompanying FIG. 1 to FIG. 12.

Figure 1:
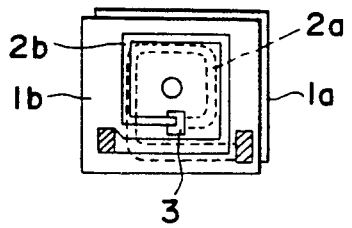
FIG. 1 is a perspective view of a laminated coil according to one embodiment of this invention.

As illustrated in FIG. 1, a laminated coil comprises a first insulating film 1*a* and second insulating film 1*b*, which is superimposed on the first insulating film. The first insulating film 1*a* has on its surface a conductive member having the spiral pattern 2*a*, while the second insulating film 1*b* has a conductive member having the spiral pattern 2*b* which extends in the direction opposite to the spiral pattern tern 2*a*.

The second insulating film 1*b* has a through-hole 3 formed at the inner end of the spiral pattern 2*b*. The inner end of the spiral pattern 2*b* is in the shape of a tongue extending over the through-hole 3. The inner ends of the spiral patterns 2*a* and 2*b* of the first and second insulating films 1*a* and 1*b* are bonded, for example, via the through-hole 3, thereby providing a laminated coil in which spiral patterns 2*a* and 2*b* are connected in series.

A third insulating film having a spiral pattern whose direction is opposite to that of the second insulating film, i.e., the spiral pattern substantially the same as that of the first insulating film, is superimposed on the second insulating film 1*b*. The outer ends of the spiral patterns of the second and third insulating films are connected by via a through-hole formed at the outer end of the spiral pattern of the third insulating film.

As described above, the insulating films having the spiral patterns which are opposite to one another are alternately superimposed, and are interconnected via the through-holes. To be more specific, the first and second insulating films are connected by their inner ends of the spiral patterns via the through-hole. The second and third insulating films are connected by their outer ends of the spiral patterns. According to this embodiment, the coil has a plurality of turns. The superimposed insulating films are then impregnated with insulating synthetic resin.

Figure 2:
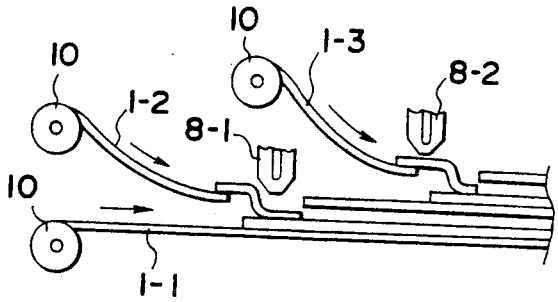
FIG. 2 is a side elevation showing the manner in which the laminated coil of FIG. 1 is made.

FIG. 2 shows one method for producing a laminated coil according to this invention. Firstly, the spiral patterns are formed beforehand on insulating films in the processes illustrated in FIGS. 3 to 9. Then the insulating films are superimposed one over another.

Figure 3:
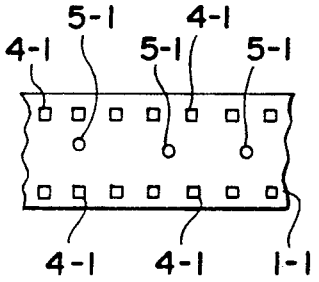
FIG. 3 is a partial plan view showing the arrangement of holes formed on a first insulating film.
Figure 4:
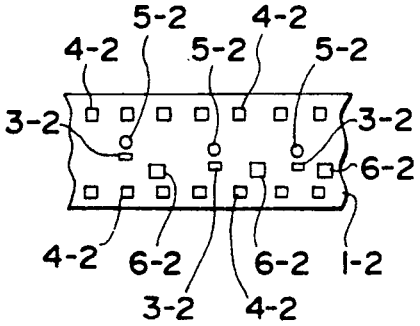
FIG. 4 is a partial plan view showing the arrangement of holes formed on a second insulating film.
Figure 5:
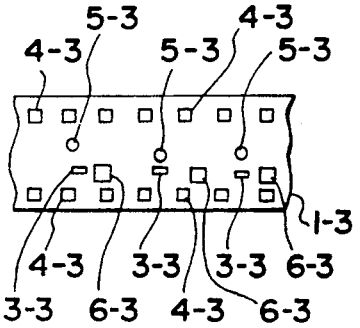
FIG. 5 is a partial plan view showing the arrangement of holes formed on a third insulating film.

As shown in FIGS. 3 to 5, holes are punched, for example, on strip-shaped insulating films 1-1, 1-2, 1-3, of polyimide, epoxy containing glass, ST resin or polyester. As illustrated in FIG. 3, a first insulating film 1-1, which has been applied an adhesive beforehand, is formed sprocket-engaging holes 4-1 and core-receptive holes 5-1. As illustrated in FIGS. 4 and 5, a second insulating film 1-2 and a third insulating film 1-3 are respectively formed not only sprocket-engaging holes 4-2 and 4-3, and core-receptive holes 5-2 and 5-3 but also through-holes 3-2 and 3-3 and lead terminal holes 6-2 and 6-3.

Figure 6:
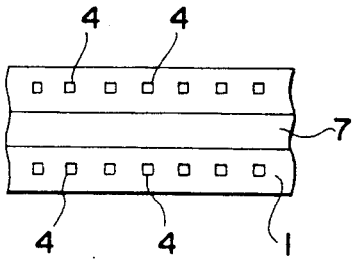
FIG. 6 is a partial plan view showing a copper foil is applied on an insulating film.
Figure 7:
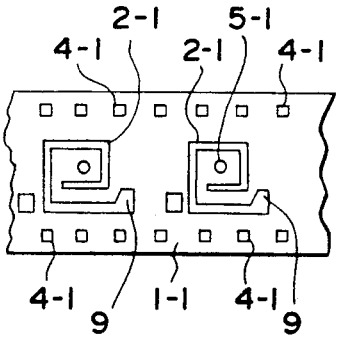
FIG. 7 is a partial plan view showing spiral patterns on the first insulating film.
Figure 8:
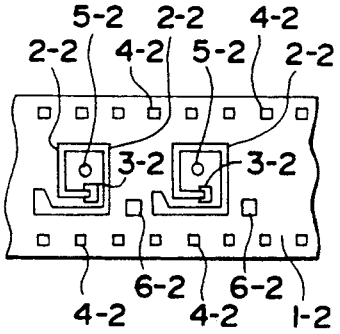
FIG. 8 is a partial plan view showing spiral patterns on the second insulating film.
Figure 9:
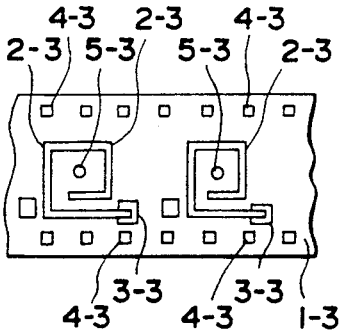
FIG. 9 is a partial plan view showing spiral patterns formed on the third insulating film.

The insulating films 1-1 to 1-3 include copper foils 7 applied by a heat roller, for example, at central portions thereof except for the sprocket-engaging holes 4-1, 4-2, 4-3, as shown in FIG. 6. Spiral patterns 2-1, 2-2, 2-3 are formed on the insulating films 1-1 to 1-3 by means of the etching technique or printed wiring technique.

To simplify the description, production of a laminated coil including three insulating films is exemplified hereinafter.

The first insulating film 1-1 has the spiral patterns 2-1 which are positioned lengthwise at the predetermined intervals around the core-receptive holes 5-1. A coil terminal 9 is located at the outer end of each spiral pattern 2-1.

The second insulating film 1-2 has a plurality of the spiral patterns 2-2, which are opposite to the spiral patterns 2-1 of the first insulating film 1-1. The inner ends of the spiral patterns 2-2 are each in the shape of a tongue extending over the respective through-hole 3-2.

The third insulating film 1-3 has a plurality of the spiral patterns 2-3 which are substantially the same as the spiral patterns 2-1 on the first insulating film. The outer ends of the spiral patterns 2-3 are each in the shape of a tongue extending over the respective through-hole 3-3. The tongues of the spiral patterns of the second insulating film and those of the third insulating film are preferably plated by tin, gold, or solder as desired. Then the insulating films 1-1 to 1-3 are respectively wound around reels.

The insulating films 1-1 to 1-3 having the spiral patterns 2-1 to 2-3 are respectively unwound from the reels so that the insulating films are superimposed one over another as shown in FIG. 2.

Figure 10:
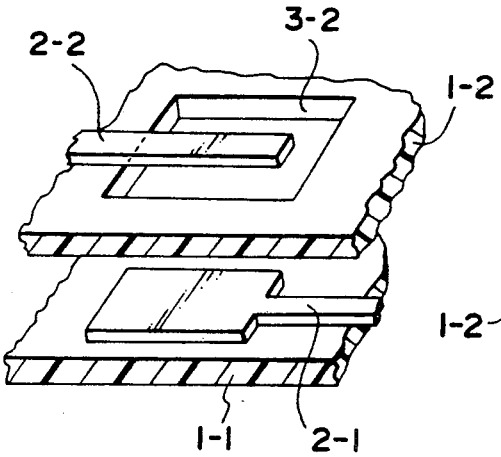
FIG. 10 is a partial cross-sectional view showing the positional relationship between a through-hole and a tongue of a spiral pattern.
Figure 11:
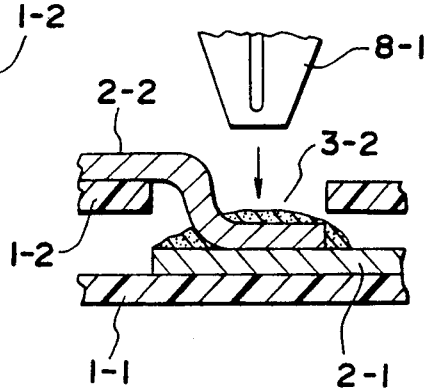
FIG. 11 is a cross-sectional view showing the manner in which the tongue is bonded to the spiral pattern is bonded.
Figure 12:
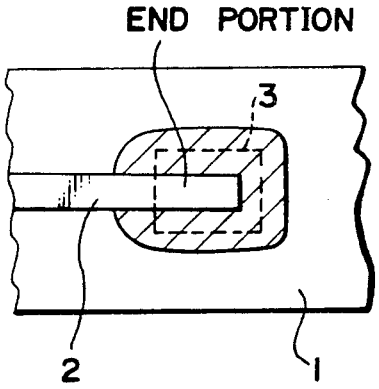
FIG. 12 is a partial plan view showing how the insulating film is punched at an end portion of the spiral pattern.

Firstly, the first insulating film 1-1 is unwound from the reel. The second insulating film 1-2 is unwound and superimposed on the first insulating film 1-1 in such a manner that the spiral patterns 2-1 and 2-2 of the first and second insulating films are aligned in the thicknessewise direction. Under this condition, each inner end of each spiral pattern 2-1 on the first insulating film 1-1 faces each associated inner tongue of each spiral pattern 2-2 of the second insulating film 1-2 via each through-hole 3-2, as shown in FIG. 10. Then, a bonding tool 8-1, for example, is downwardly inserted into the through-hole 3-2. Therefore the tongue of the spiral pattern 2-2 is pushed by the bonding tool 8-1 and is caused to contact with the inner end of the spiral pattern 2-1 of the first insulating film, so that both ends of the spiral patterns 2-1 and 2-2 will be instantly bonded each other.

After connecting the spiral patterns 2-1 and 2-2, a third insulating film 1-3 is unwound so that its spiral pattern 2-3 is superimposed on the spiral pattern 2-2 of the second insulating film 1-2. Then the outer end of the spiral pattern 2-2 of the second insulating film faces the outer tongue of the spiral pattern 2-3 of the third insulating film via the through-hole 3-3 on the third insulating film. Under this condition, a bonding tool 8-2 is downwardly inserted into the through-hole 3-3, so that the tongue of the spiral pattern 2-3 is pushed and is made to contact with the end of the spiral pattern 2-2 on the second insulating film. Then both ends of the spiral patterns 2-2 and 2-3 are instantly bonded together.

As described above, the ends of the spiral patterns 2-1, 2-2 and 2-3 of the first to third insulating films are connected in series, so that coils having a plurality of turns are formed on the superimposed insulating films. The superimposed insulating films 1-1 to 1-3 are then temporarily fastened, and are cut to separate the coil patterns from one another. The separated coil patterns are impregnated with casting insulating resin, so that laminated coils will be obtained as desired.

Having thus described the invention, it will be understood that various changes and modifications may be made in the foregoing embodiment without departing from the scope of the appended claims. For instance, the core-receptive holes 5-1 to 5-3, which are formed on the insulating films 1-1 to 1-3 beforehand, may be punched after the insulating films are superimposed. In the foregoing embodiment, the through-holes 3-2, 3-3 are formed on the insulating films 1-2, 1-3 before they are superimposed. However, these through-holes may be formed, by a resin etching method for example, after the spiral patterns 2-2, 2-3 are disposed on the insulating films. Otherwise, the through-holes 3 may be temporarily formed on the insulating films 1-1, 1-2 beforehand, and may be enlarged as desired by punching as shown by the shaded portion in FIG. 12 after the spiral patterns 2-2, 2-3 are disposed on the insulating films.

In the foregoing embodiment, the ends of the spiral patterns are bonded, but may be connected by means of the spot-welding or soldering.

It is needless to say that the laminated coil according to this invention is suitable not only for switching power supplies but also for a variety of applications.

Further, this invention is also applicable to coils of arc-shaped patterns.

With this invention, the through-holes are formed at the ends of the spiral patterns on the insulating films except for the lowermost insulating film. The conductive patterns on a pair of adjacent insulating films are connected in such a manner that each tongue of the conductive members on the upper insulating film is connected to each end of the associated conductive members on the lower insulating film. Therefore, the conductive patterns on the respective insulating films which are unwound one after another can be continuously connected in a short period of time without interrupting the production line, thereby facilitating the production of the laminated coil with efficiency.

What is claimed is:

1. A method for producing a laminated coil, comprising steps of:

(a) providing a plurality of insulating films, each film of said plurality of insulating films having a predetermined number of non-conducting through-holes;

(b) mounting a predetermined number of conductive members on said each film of said plurality of insulating films, each conductive member of said conductive members having a tongue extending into a corresponding through-hole;

(c) superimposing, one over another, said plurality of insulating films on which said predetermined number of conductive members have been mounted; and (d) electrically connecting a respective tongue of each said conductive member mounted on said each film of said plurality of insulating films with an associated conductive member of an insulating film adjacent to each said film via a through-hole corresponding to said respective tongue to obtain a predetermined number of coil patterns each for a laminate coil.

2. A method according to claim 1, further comprising the step of cutting the superimposed insulating films to separate said coil patterns from one another when said predetermined number of conductive members mounted on said each film during said mounting step is more than one and said predetermined number of coil patterns obtained during said connecting step is more than one.

3. A method according to claim 1, wherein said connecting step includes bonding said tongue of each said conductive member to the adjacent associated conductive member.

4. A method according to claim 1, further comprising the step of impregnating said coil patterns with an insulating material.

5. A method according to claim 1, wherein said mounting step includes:

applying a metallic foil on each said insulating films; and shaping said metallic foil into a predetermined pattern to form said conductive members and also to form said tongues each integrally with the respective conductive member.

6. A method according to claim 1, wherein said superimposing step includes winding said insulating films around a roll.

7. A method according to claim 1, further comprising the step of forming a plurality of core-receptive holes in each said insulating film.

8. A method according to claim 1, further comprising the step of forming a predetermined number of through-holes in each said insulating film.

9. The method of claim 8, wherein the step of mounting includes a step of forming the tongue at an end of a corresponding conductive member so as to extend into the corresponding through-hole.

* * * * *